US007465238B2

(12) United States Patent
Wallace

(10) Patent No.: US 7,465,238 B2
(45) Date of Patent: Dec. 16, 2008

(54) GOLF CLUB

(76) Inventor: Robert D. Wallace, 1654 So. Camrose Way, Anaheim, CA (US) 92802

( * ) Notice: Subject to any disclaimer, the term of this patent is extended or adjusted under 35 U.S.C. 154(b) by 75 days.

(21) Appl. No.: 11/141,718

(22) Filed: May 31, 2005

(65) Prior Publication Data

US 2006/0270485 A1 Nov. 30, 2006

(51) Int. Cl.
*A63B 53/14* (2006.01)
*A63B 53/04* (2006.01)

(52) U.S. Cl. ..... 473/292; 473/349

(58) Field of Classification Search ..... 473/252, 473/324–350

See application file for complete search history.

(56) References Cited

U.S. PATENT DOCUMENTS 1,703,199 A * 2/1929 Mcclure ..... 473/243
D247,791 S * 4/1978 Monteleone ..... D21/741
4,114,886 A * 9/1978 Koch ..... 473/238
4,325,550 A * 4/1982 Thompson et al. ..... 473/313
RE35,931 E 10/1998 Schroder
6,106,411 A 8/2000 Edwards
6,354,962 B1 * 3/2002 Galloway et al. ..... 473/342
6,659,882 B2 12/2003 Patsky

FOREIGN PATENT DOCUMENTS

JP 2003230641 A * 8/2003

* cited by examiner

*Primary Examiner*—Gene Kim
*Assistant Examiner*—Alvin A Hunter

(57) ABSTRACT

A golf club comprising a clubhead with a sole profile shaped in an inverted peak roof, the clubhead having a line of centers of percussion which intersects the sole at the peak and which runs through the centroid of the clubface. The line of centers of percussion is marked on the clubface replacing the conventional icon so as to provide a visual indication to the golfer of the points of impact on the clubface from sole to crown which produce minimal shaft twisting upon contact with the ball. Upon contact with the ground, the clubhead presents a single point of contact located on the line of centers of percussion and shaft twisting due to ground contact is also minimized.

20 Claims, 6 Drawing Sheets

GOLF CLUB

BACKGROUND

The present invention relates to golf clubs that offer improved performance due to their novel design.

All golf clubs with a configuration comprising grip, shaft, and head with a face, heel, toe, sole, and crown—meeting USGA regulations—will have locations on the face between heel and toe, extending from sole to crown, which can be designated as centers of percussion. A line which may be termed a "line of centers of percussion" can then be drawn on the clubface connecting these points from sole to crown. It will be found that this line is parallel to the shaft axis (i.e., centers of percussion are at constant radius from the shaft axis at all elevations on the clubface).

This terminology of "center of percussion" is very specific as described in Wiley's, "Engineer's Desk Ref.", 1984, page 96 (which page is herein incorporated by reference), and should not be confused with center of gravity, geometric center, or any other "center" description that might be loosely used or in fashion. Its significance lies in the fact that it is the ONLY location between heel and toe—at a particular elevation—which defines the point at which ball impact will not produce shaft twisting. Impacts between this point and the heel of the club will produce counter-clockwise shaft twisting (from the golfer's viewpoint), and impacts between this point and the toe of the club will produce clockwise shaft twisting. Both are undesirable.

The reason for this performance is as follows. For any given impact point the clubhead can be divided into two sections: an inboard section and an outboard section. The inboard section is defined as the section running from the heel to a line on the clubface parallel to the clubshaft and running through the impact point. The outboard section is defined as the section running from the toe to the same line. The line of centers of percussion is established by the outboard and inboard sections having identical moments of inertia about the clubshaft axis. These results come from a dynamic action in which the ball (or ground) impact produces an abrupt clubhead deceleration focused at the point of impact. This in turn causes the mass of each of the inboard and outboard sections to want to continue its motion at its original speed and direction because of its inertia. Whereas the static concept of center of gravity is defined by weight at a linear distance from the center of gravity, the dynamic center of percussion is defined by mass times the shortest distance from the axis of concern squared ($I=md^2$, where I is the moment of inertia). An Impact point on the line of centers of percussion will yield a moment of inertia about the shaft axis for the inboard section equal to that for the outboard section and will result in no shaft twisting. Conversely, impact points at locations other than a center of percussion will then produce imbalances between the moments of inertia of the inboard and outboard sections and will result in shaft twisting.

A critical feature of the center of percussion which distinguishes it from the static center of gravity, for example, is that it remains immutable from earth to space. That is, impacts on a clubface under testing will yield exactly the same shaft twisting for the same impact location whether on earth or in space (zero gravity environment). Since there is no such thing as "center of gravity" in outer space at zero gravity, this demonstrates that the singular parameter governing shaft twisting is the center of percussion, NOT the center of gravity or other so-called "center".

It is recognized that in an earth environment, changing the center of percussion by changing mass distribution will also change the center of gravity. However, this does NOT make them one and the same parameter. One is a static parameter, and the other is a dynamic parameter immutable from earth to outer space and singularly relevant to golf equipment and playing practice. Further, with an irregular three-dimensional body it is impossible to demonstrate proof of the location of the static center of gravity, but proof of a center of percussion location can be demonstrated practically.

The ball is not the only body that impacts the clubhead during a game of golf, and shaft twisting can also be caused by ground contact of the clubhead. Again, this twisting is undesirable and should be minimized or eliminated for improved performance of a new golf club design.

It would also be very useful to provide golfers with a new golf club specifically designed to have a line of centers of percussion located near the centroid of the clubface. Additionally, it would be very useful to clearly mark on the clubface the location of the line of centers of percussion so that the golfer can attempt to strike the ball on this line at all ball elevations, thereby preventing shaft twisting. Further, it would also be very useful to provide a new golf club design that minimizes shaft twisting due to ground contact of the clubhead.

The main objective of this invention is to minimize golf club shaft twisting when impacting both ball and ground. This objective can be realized for all club/shaft configurations which meet USGA regulations, and it is achieved by providing two design features which are uniquely coupled together in a preferred embodiment:

1. A clubhead design having a line of centers of percussion—manipulated by design, testing and manufacture—which goes through the centroid of the clubface area, and having a "permanent" stain on the clubface showing the location of this line of centers of percussion for the golfer's guidance—at ALL ball elevations from the ground. This design is achieved by manufacturing the clubhead such that a line going through the centroid of the clubface and parallel to the club shaft axis, divides the clubhead into two sections of substantially equal moments of inertia about the clubshaft axis. By definition this line is then the line of centers of percussion and its location can be marked on the clubface with a permanent stain. It is important to note that:
   a. No golf club manufacturer has ever offered by design a center of percussion or line of centers of percussion—visible or otherwise—on their clubs.
   b. No golf club manufacturer has ever located by design a center of percussion or line of centers of percussion near the centroid of face area so as to offer improved surrounding area tolerance for misshits. (Current clubs, irons in particular, have a line of centers of percussion—as discovered by random testing—very close to the hosel which can easily result in the dreaded shank from a modest misshit.)
2. A sole profile (front elevation view) in the form of an inverted peak roof, the objective of which is to provide one singular point—the peak—which will make initial contact between sole and ground.

The unique coupling of this feature with the previous item (1) is then achieved by locating this peak substantially coincident with a point on the line of centers of percussion. In short, the line of centers of percussion preferably goes through both the centroid of the clubface and the peak. In this way ground impacts will act like ball impacts on the line of centers of percussion and will produce no shaft twisting. This is a truly superior arrangement. An inverted peak roof type sole profile has been in common use for some clubs, particularly the "woods". However, the foregoing unique coupling has never been attempted prior to this invention. Nor has anyone made an inverted peak roof profile with OTHER than flat surfaces from peak to toe and peak to heel—all potentially desirable configurations for the purposes of this invention.

SUMMARY

One of the main objectives of this invention is to provide golf clubs—"woods" and irons—that will minimize twisting of the golf club shaft in the hands of the golfer on impact with the ground and/or the ball.

This is accomplished by shaping the sole of the clubhead, and uniquely coupling this feature with a clubhead having a balanced moment of inertia about a line of centers of percussion, extending from sole to crown on the face of the clubhead.

The sole is preferably shaped like an inverted peak roof so that the initial point of contact of the sole with the ground when taking the usual divot will be confined to the peak. The unique coupling is then obtained by designing this peak to be positioned on the sole, between heel and toe, such that it intersects with the line of centers of percussion on the face of the club.

A further objective of this invention is to locate the line of centers of percussion so that it will go through the centroid of the clubface area. In other words, the line of centers of percussion preferably goes through the centroid of the clubface area and also intersects the peak at the sole. This line can then be visually marked on the clubface so as to give the golfer a way to align himself at address. If therefore the golfer aligns himself properly at address and impacts the ball on the line of centers of percussion—regardless of ball elevation above ground—either taking or not taking a divot, he will experience no shaft twist in his hands and obtain best performance.

In one aspect of the present invention a new golf club design is provided with a known line of centers of percussion which is clearly marked on the clubface, thereby indicating to the golfer the optimal impact points. The golf club is manufactured such that the line of centers of percussion is placed at the desired location on the clubface, preferably near the centroid of the clubface. The clubface of this novel golf club design is preferably marked from crown to sole to clearly show the line of centers of percussion to the golfer.

In another aspect of the present invention, a novel golf club is provided with a clubhead having a line of centers of percussion on the clubface located by design near the centroid of the clubface. This is realized by designing the clubhead such that a line parallel to the shaft and going through the centroid of the clubface divides the clubhead into two sections of substantially equal moments of inertia.

In yet another aspect of this invention, a novel golf club is provided which minimizes shaft twisting upon ground impact. This is realized by shaping the sole of the clubhead in the configuration of an inverted peak roof so that the first ground contact when taking the usual divot will occur at the inverted peak. In a preferred embodiment of the present invention, the inverted peak is placed by design where the sole meets the line of centers of percussion so that the inverted peak is a point on the line of centers of percussion. In this way, shaft twisting due to ground contact is minimized. In other words, all contacts, ball or ground, when the ball is struck on the line of centers of percussion, will result in minimal or no shaft twisting. Preferably, the golf club is designed such that the line of centers of percussion runs through an area on the clubface which is in the near proximity of the centroid of the clubface.

In yet another aspect, the present invention relates to a method of making golf clubs which exhibit reduced shaft twisting upon clubhead impact with the ground and/or ball, the method comprising the steps of: 1) designing the clubhead such that the line of centers of percussion goes through the centroid of the clubface; 2) shaping the sole in an inverted peak roof, wherein the line of centers of percussion runs through the peak; and 3) providing markings on the clubface to show the location of the line of centers of percussion in order to allow the golfer to align himself at address so as to strike the ball on the line of centers of percussion.

Other objectives and advantages of the present invention will become apparent from the following detailed description when viewed in conjunction with the accompanying drawings, which set forth certain embodiments of the invention.

DETAILED DESCRIPTION

The detailed embodiments of the present invention are described herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
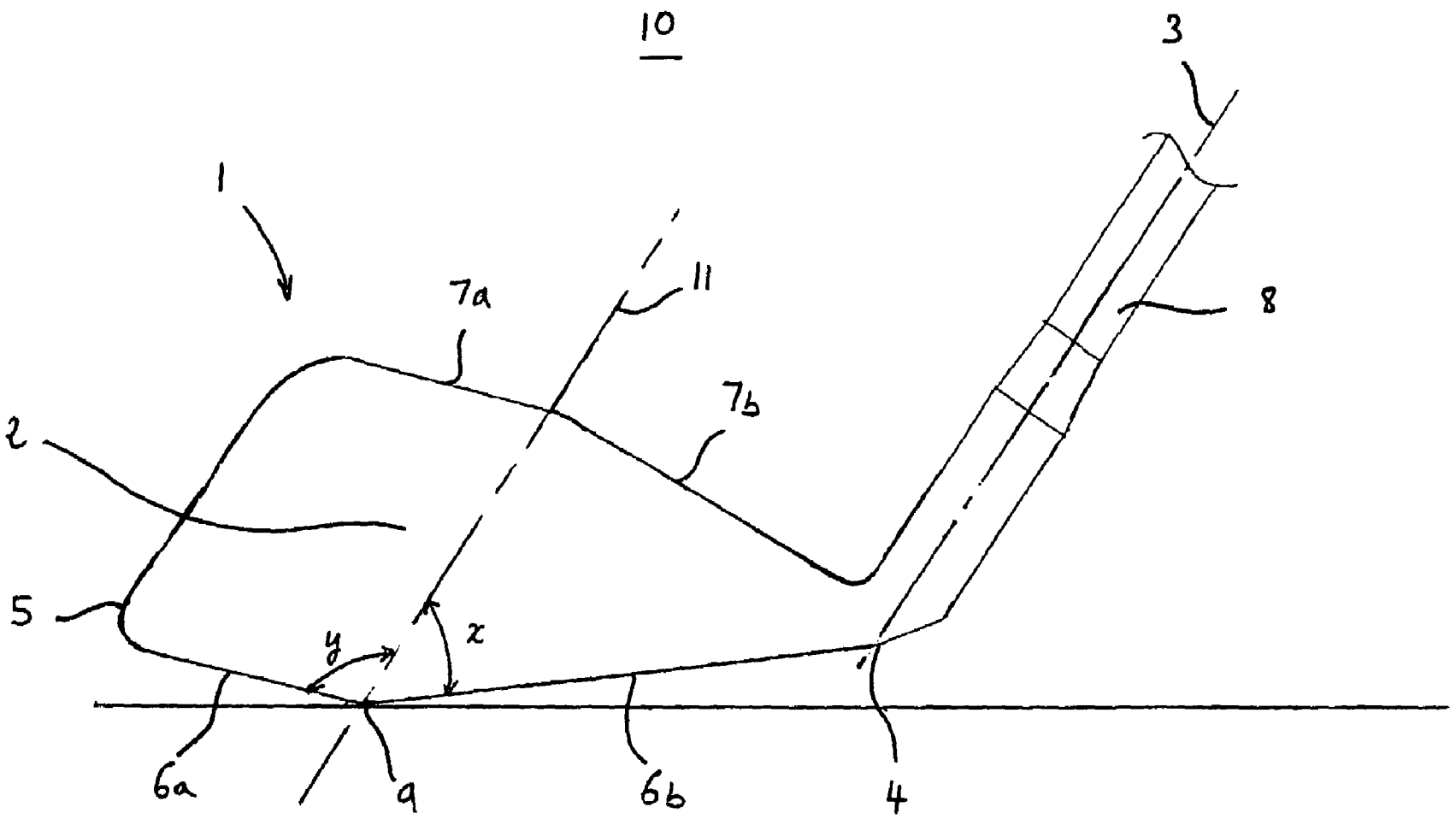
FIG. 1 is a front view of a golf club showing the sole shaped in an inverted peak roof, in accordance to an embodiment of the present invention.

Referring to FIG. 1, a golf club 10 in accordance with the present invention is shown. In the drawings, the golf club 10 is not shown in its entirety as the invention mostly encompasses modifications of the clubhead 1. The shaft 8 of the golf club 10 extends upwardly and terminates in a conventional grip (not shown) to allow the golfer to grasp and swing the golf club 10.

Clubhead 1 includes clubface 2, heel 4, toe 5, sole 6 (comprising toe-ward sole portion 6*a* and heel-ward sole portion 6*b*) and crown 7 (comprising toe-ward crown portion 7*a* and heel-ward crown portion 7*b*). Toe-ward sole portion 6*a* and a heel-ward sole portion 6*b* intersect at inverted peak 9. Line 11 is defined with two parameters: 1) line 11 is parallel to axis 3; and 2) Line 11 intersects inverted peak 9. Angle y is the angle formed by toe-ward sole portion 6*a* and axis 11, while angle x is the angle formed by heel-ward sole portion 6*b* and axis 11. In this novel club design, the angles x and y do not have to hold any particular values, they may be equal, x may be more than y, or x may by less than y depending on the particular design desired by the club maker. However, in a preferred embodiment of the present invention sole 6 presents an inverted peak 9 to the ground contact point. Further, the toe-ward sole portion 6*a* and heel-ward sole portion 6*b* are not required to have a linear or "flat" shape, but can assume any shape deemed desirable by the club maker, provided inverted peak 9 is such that ground contact occurs first at peak 9.

Figure 2:
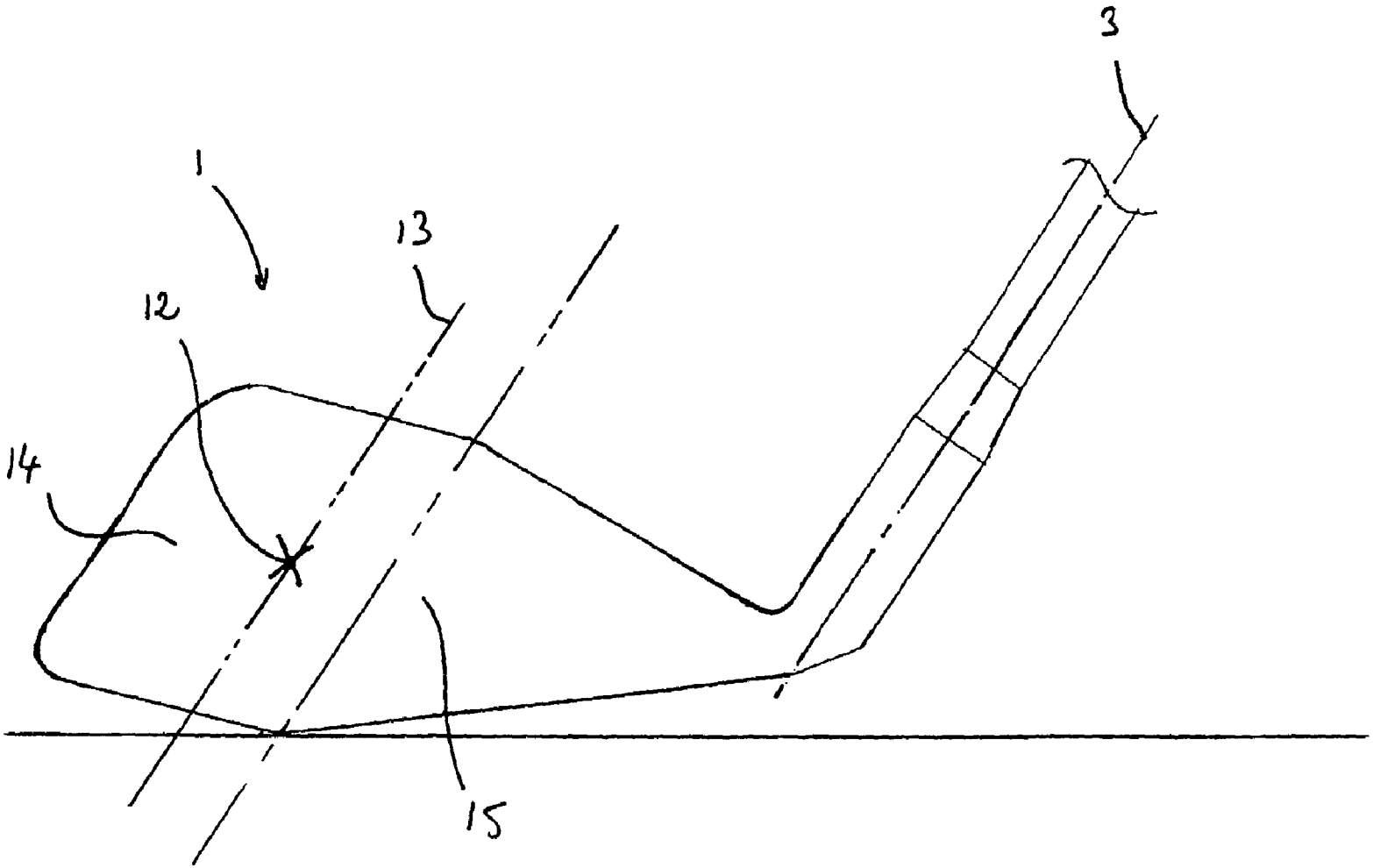
FIG. 2 is a front view of a golf club showing a possible point of impact on the clubface.

Referring to FIG. 2, a possible ball impact location 12 is shown. Line 13 (defined as the line parallel to axis 3 and running through ball impact location 12) divides clubhead 1 into two portions: outboard portion 14 and inboard portion 15. Each of outboard portion 14 and inboard portion 15 has a moment of inertia with respect to axis 3, which is related to the mass and the square of the shortest distance to axis 3. The moment of inertia about the shaft axis $I_{out}$ of the outboard portion 14 can be calculated by any method know in the art, as can the moment of inertia about the shaft axis $I_{in}$ of the inboard portion 15.

Depending on the particular location of the ball impact 12, $I_{out}$ can be greater, equal to or less than $I_{in}$. If $I_{in}$ is less than $I_{out}$, then the impact will produce counter-clockwise shaft twisting (from the golfer's point of view), if $I_{in}$ is more than $I_{out}$, then the impact will produce clockwise shaft twisting, if $I_{in}$ is equal to $I_{out}$, then the impact will produce no shaft twisting, and in this case, the point of impact is referred to as a center of percussion. It will be found that there exists an infinite number of centers of percussion on a clubface from sole to crown which form a line on the clubface parallel to shaft axis 3 and referred to as the line of center of percussion.

Figure 3:
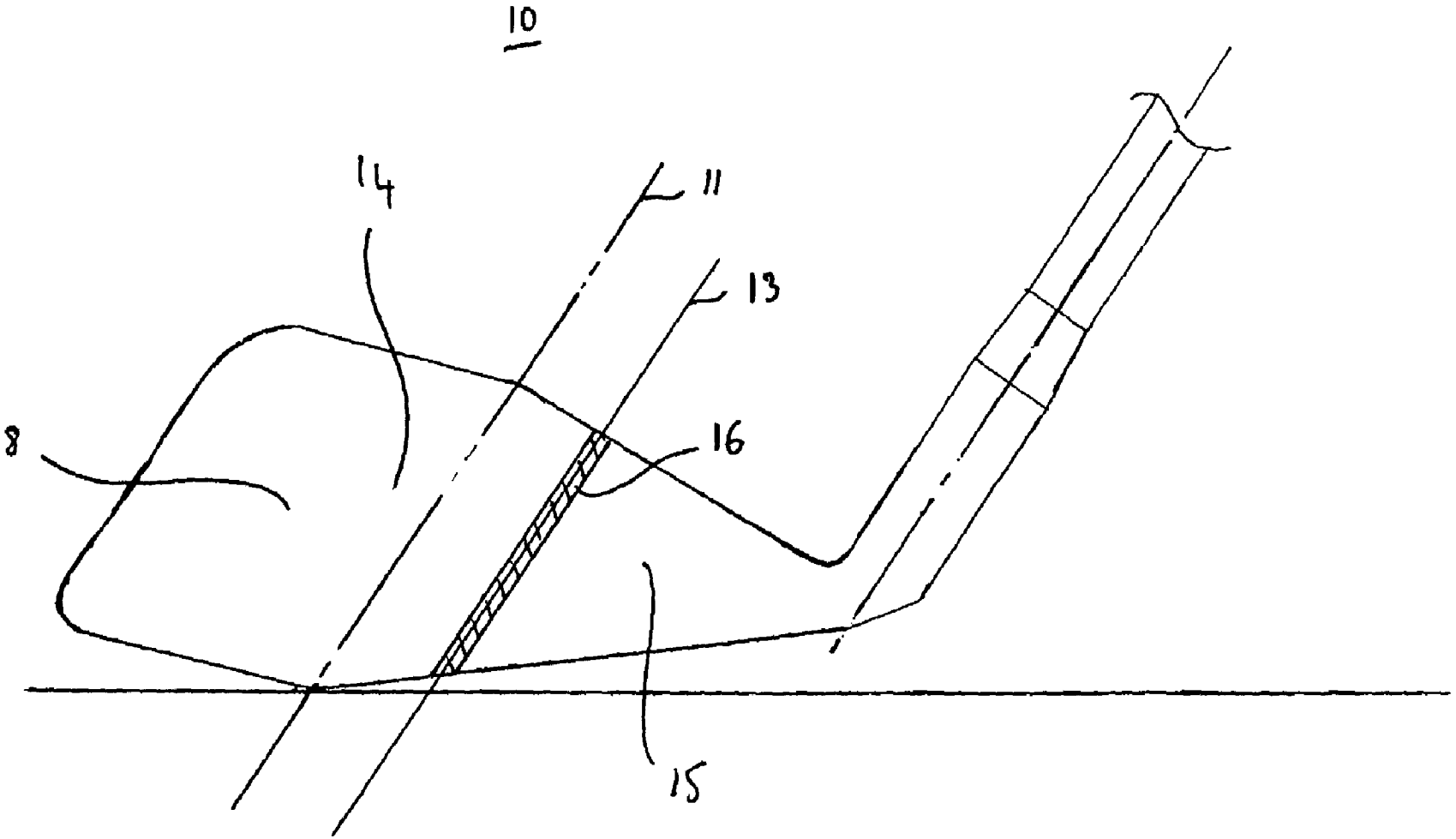
FIG. 3 is a front view of a golf club of the present invention showing a possible location of the line of centers of percussion on the clubface.

Referring to FIG. 3, a clubhead in accordance with the present invention is shown having a line of centers of percussion 13, which divides the clubhead into inboard portion 15 and outboard portion 14 having equal moments of inertia ($I_{in}=I_{out}$). Although FIG. 3 shows a sole shaped in an inverted peak roof, any other profile of the sole—including but not limited to a curved inboard and outboard sections—is within the scope of this embodiment. The location of the line of centers of percussion 13 is indicated on the clubface 8 with a stain or marking 16 centered on the line of centers of percussion 13. Any way of providing to the golfer a visual signal indicating the location of the line of centers of percussion 13 is within the scope of this invention. The shape, width, intensity, etc. of marking 16 is arbitrary and has the sole purpose of indicating to the golfer the location of the line of centers of percussion. This marking will help the golfer in his alignment at address to attempt to strike the ball on the line of centers of percussion, thereby avoiding or greatly minimizing any undesirable twisting of the shaft 1.

Figure 4:
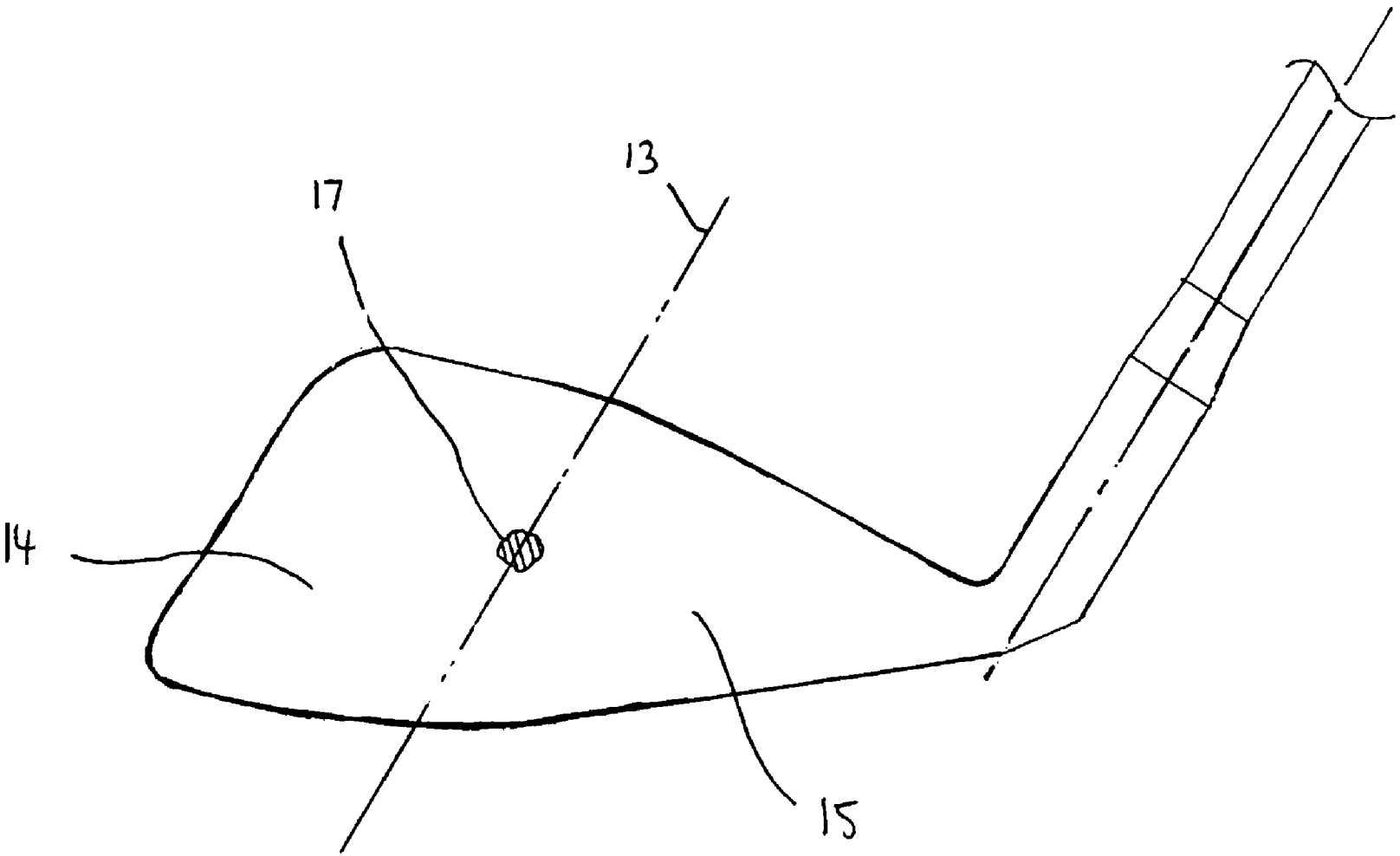
FIG. 4 is a front view of a golf club of the present invention showing the line of centers of percussion running through the centroid of clubface.

Referring to FIG. 4, a clubhead in accordance with a preferred embodiment of the present invention is shown. In this embodiment, the line of centers of percussion 13 is positioned by design near the centroid 17 of the clubface. In other words, a line running through the centroid 17 divides the clubhead into two portions, inboard portion 14 and outboard portion 15 having equal moments of inertia about the shaft axis. $I_{in}$ and $I_{out}$, respective moments of inertia about the shaft axis of inboard portion 14 and outboard portion 15, are set by design to have substantially equal values. This balance between moments of inertia of the two portions of the clubhead on each side of the centroid of the clubface is one of the unique design requirements for this embodiment. The location of the line of centers of percussion near the centroid will maximize tolerance to misshits. The location of the line of centers of percussion is preferably marked on the clubface as in the embodiment of FIG. 3. In the present embodiment (FIG. 4) this marking is of particular importance since the golfer will be guided as to where to address the ball depending on its elevation above ground since at each elevation the location of the center of percussion shifts between heel and toe (to remain on the line of centers of percussion). However, designs without this marking are also within the scope of this invention. Note that, in this embodiment, the shape of the sole, crown or any other part of the clubhead is arbitrary.

Figure 5:
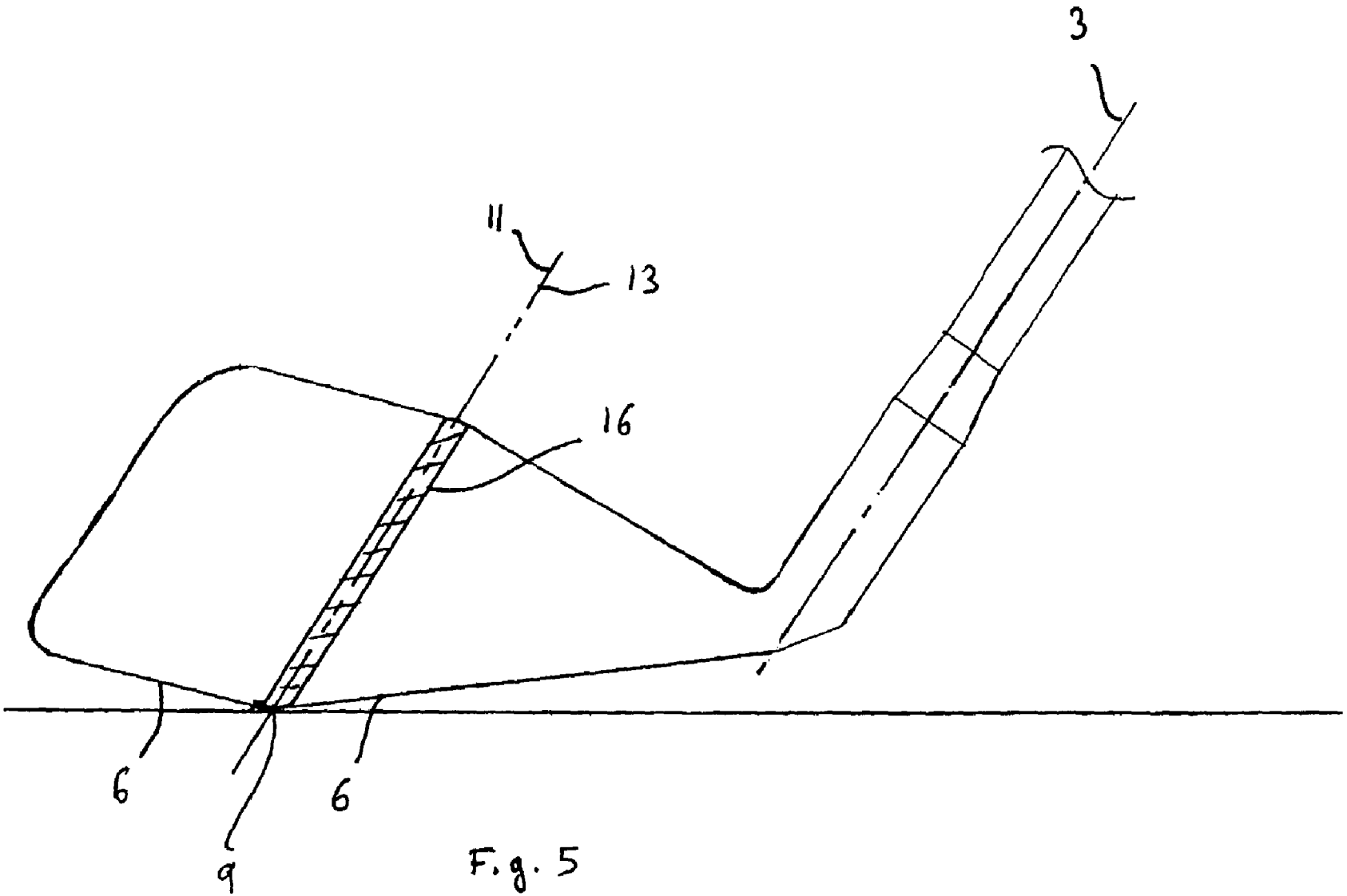
FIG. 5 is a front view of a golf club of the present invention showing the line of centers of percussion running through the centroid of the clubface and intersecting the sole at the inverted peak.

Referring to FIG. 5, a most preferred embodiment of the present invention is shown. This embodiment combines the design feature of FIG. 1 (sole shaped in an inverted peak roof) with the design feature of FIG. 4 (line of centers of percussion running through the centroid of the clubface) with the further design requirement that the line of centers of percussion substantially intersect sole 6 at peak 9. In other words, axis 11 (the line parallel to shaft axis 3 and running through inverted peak 9) and the line of centers of percussion 13, substantially coincide. The centroid of the clubface is not shown in FIG. 5 so as to not clutter the figure. However, it is understood that the line of centers of percussion runs through the centroid in this most preferred embodiment. In this configuration, when a ball in struck on the line of centers of percussion 13, and a divot taken, the twisting of shaft 1 is minimized not only because the ball impact is on the line of centers of percussion, but also because the initial point of ground contact (at the inverted peak 9) is also on the line of centers of percussion 13. Thus, each impact (ball and ground) on or near line of centers of percussion 13 will cause no twisting or substantially minimal twisting of the shaft 8, thereby affording more power, control and precision to the golfer.

Additionally, since the line of centers of percussion 13 runs through the centroid of the clubface, the two portions of the clubface on each side of line of centers of percussion 13 will roughly have equal surface areas and this design will be more forgiving to misshits. Indeed, ball impacts outside the line of centers of percussion 13 but still near the centroid will enjoy adequate surface area for a proper hit.

In this most preferred embodiment the location of the line of centers of percussion 13 is preferably indicated on the clubface at the option of the manufacturer or golfer by using marking 16. This marking will then replace the conventional icon (circle, diamond, etc.) found on clubfaces to date. As in the embodiment of FIG. 3, marking 16 may be of any nature.

A less desired design, but nonetheless within the scope of the present invention, may be envisioned where the line of centers of percussion is arbitrarily positioned between heel and toe by weight manipulation to suit a singular demand. In this case, the position of the peak would have to be adjusted to meet the new line of centers of percussion and the clubface marking for the line of centers of percussion also relocated.

Many ways of designing and manufacturing golf clubs in accordance with this invention will be apparent to one skill in the art. In accordance with the most preferred embodiment of the present invention, the design specifications will have the following three requirements:

1) the sole profile is shaped in the configuration of an inverted peak;
2) the line running through the inverted peak parallel to the shaft axis divides the clubhead into two portions of equal moments of inertia with respect to the shaft axis (i.e., the line of centers of percussion runs through the inverted peak); and
3) the line of centers of percussion runs through the centroid of the clubface.

The line of centers of percussion is preferably marked on the clubface so as to provide the golfer with a visual guide at address showing the preferred ball impact area on the clubface for all ball elevations above ground.

Figure 6:
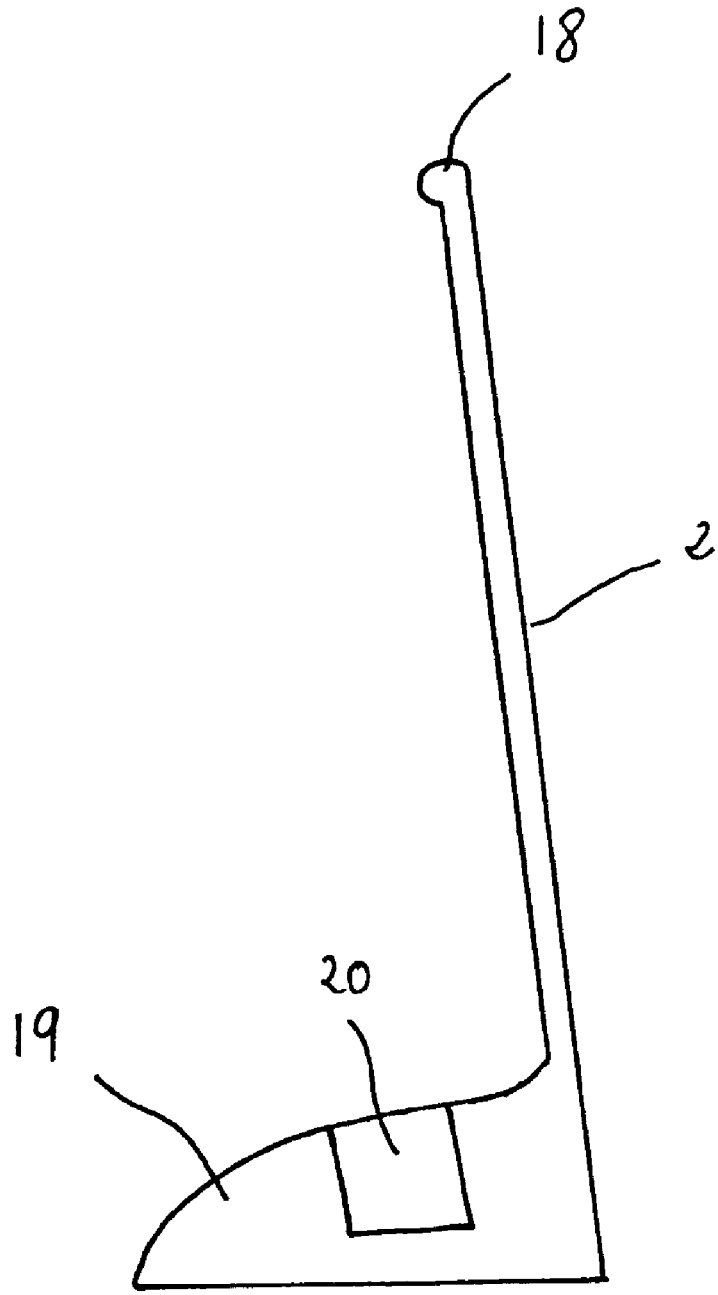
FIG. 6 is a cross-section view of a clubhead of the present invention having a pocket for adjusting the weight distribution of the clubhead.

According to the present invention, the clubhead is provided with means of adjusting the position of the line of centers of percussion. FIG. 6 shows a cross-section of a clubhead according to one such possible design. The clubface 2 is shown as a thin plate with a small stiffening bead 18 at the crown and a rather large flange 19 projecting rearward, where the majority of the clubhead weight is contained. The distribution of this weight between heel and toe then provides the primary means of achieving the desired location fort the line of centers of percussion. Pockets 20 in flange 19 may then be provided to allow small adjustments for the inescapable manufacturing tolerances. A thin plate may be employed in order to leave as large a balance of weight needed to bring the whole clubhead to standard weight for its loft. This remaining balance of weight to be added can then be devoted to a sole flange, and the distribution of this weight adjusted from heel to toe so as to produce the desired position for the line of centers of percussion. If this weight and its possible distribution cannot meet the demands of the desired positioning of the line of centers of percussion, recourse then may be taken to the use of tungsten powder plugs in the pockets provided.

Golf clubs which have been manufactured with design specifications in accordance with the present invention may be tested in order to ensure that the line of centers of percussion is located as intended by design. A simple test rig may be constructed from plastic water pipe. A pipe which internally rigidly contains the golf club and is about as long as the grip, is hung inside of another close fitting pipe by a short length of piano wire. This assembly is then mounted on a vertical board so as to swing freely, left and right, in the vertical plane. Since the inner tube with golf club is free to twist on the piano wire, it is then a simple matter to tap from heel to toe along a score line with a center punch and small hammer to find the point of zero twist. A short length of tape with inch or centimeter markings can be pasted on the face of the club to facilitate recording the point of zero twist. The radius of this point from the club axis can then be recorded and transferred to the club face at other elevations from sole to top or crown so as to form the line of centers of percussion. This is a simple, manual method. A more sophisticated one may use a torque tube with strain gauge in place of the piano wire, and a door-bell type impacter on a slide bar in place of the center punch and hammer.

To manufacture golf clubs in accordance with the present invention, a prototype set of clubs may be first fabricated. For example, CAD software may be used to create a prototype set of clubs according to the above requirements. These prototype clubs are preferably adjustable so as to provide a way to correct errors in the placement of the line of centers of percussion due to manufacturing tolerances. The prototype set would, after adjustments of the line of centers of percussion for each club to the exact desired locations (i.e., running through the inverted peak and the centroid of the clubface), be used as a master set. The exact line of centers of percussion location for each club in the set may be achieved by trial and error (e.g., by determining the location of the line of centers of percussion, then weighting the clubhead sole flange to move it near the desired location, then determining the location of the line of centers of percussion again, then weighting the clubhead and so on until the desired location is reached. Using the adjusted master set of clubs, a manufacturing process can then be devised to produce replicas of the master set with tolerances appropriately set so as to ensure minimal variations of the line of centers of percussions with respect to the master set. Preferably, replicas would be tested periodically (e.g., every $20^{th}$ or $100^{th}$ set produced) so as to ensure proper positioning of the line of centers of percussion (i.e., within acceptable bounds determined at the design stage). A test rig such as mentioned above or any other such method may be used to perform quality control.

It is to be noted that:

The shape of a golf club in accordance with the present invention is arbitrary except for the required inverted roof peak 3 of the sole for the most preferred embodiment of the present invention;

In a preferred embodiment, the angle between ground and heel-ward sole portion should preferably be approximately equal to that between ground and the toe-ward sole portion;

The size of the clubface is arbitrary as is the trapezoidal clubface shape shown in the figures;

The blade of the club (irons) should preferably be thin with the bulk of the clubhead weight distributed along the sole aft of the clubhead so as to maximize the distribution at the toe of the club. This preferred design specification is established in order to assure that the line of centers of percussion will be forced out to about the centroid of face area, and may also be facilitated by the use of tungsten inserts near the toe.

The angle of the inverted roof peak z (where z=x+y) is arbitrary and z may be have any practical value. One practical range for z will generally be between 120 to 179 degrees.

From the foregoing description it will be apparent that modifications can be made to the apparatus without departing from the teaching of the present invention. Accordingly, it is distinctly understood that the invention is not limited to the preferred embodiment but may be embodied and practiced within the scope of the following claims.

The invention claimed is:

1. A golf club comprising:

a) a clubhead including a clubface, the clubface having a centroid; and b) a shaft connected to the clubhead, the shaft having a shaft axis;

wherein a line on the clubface running through the centroid, substantially parallel to the shaft axis, and distinct from the shaft axis, divides the clubhead into two portions of different masses and substantially equal moments of inertia about the shaft axis.

2. The golf club of claim 1, wherein the location of said line is indicated by a marking on the clubface so as to provide a golfer with a visual indication, of the area of the clubface which produces minimal twisting of the shaft upon contact with a golf ball at all elevations above the ground.

3. The golf club of claim 2, wherein the clubhead includes a sole, the sole having a toe-ward sole portion and a heel-ward sole portion, and wherein the toe-ward sole portion and the heel-ward sole portion intersect at a peak so as to form a sole profile which presents a reduced area of contact when the clubhead bits the ground.

4. The golf club of claim 3, wherein the toe-ward sole portion and the heel-ward sole portion are substantially flat surfaces.

5. The golf club of claim 3, wherein the toe-ward sole portion and the heel-ward sole portion are curved surfaces.

6. The golf club of claim 3, wherein the golf club is a wood.

7. The golf club of claim 3, wherein the golf club is an iron.

8. The golf club of claim 7, wherein more than fifty percent of the weight of the clubhead is concentrated along the sole area aft of the clubhead.

9. The golf club of claim 3, wherein an angle formed at the peak by the toe-ward sole portion and the heel-ward sole portion is between 120 and 179 degrees.

10. The golf club of claim 1, wherein the sole includes a flange projecting rearward, and wherein the flange has at least one pocket for placing weighting material within its interior so as to allow adjustment of the weight distribution of the clubhead, in turn allowing adjustment of a line of centers of percussion to the desired location.

11. The golf club of claim 10, wherein the weighing material includes tungsten powder.

12. A golf club comprising:

a) a clubhead including a clubface and a sole; and b) a shaft connected to the clubhead, the shaft having a shaft axis;

wherein the sole is shaped in an inverted peak root; and wherein a line of centers of percussion which is distinct from the shaft axis divides the clubhead into two portions of different masses and substantially equal moments of inertia, and wherein the line is marked on the clubface so as to give to the golfer a visual indication of the area on the clubface which produces minimal twisting of the shaft upon contact with a golf ball.

13. The golf club of claim 12, wherein the line of centers of percussion intersects the sole at a peak of the inverted peak roof.

14. The golf club of claim 13, wherein the line of centers of percussion runs through a centroid of the clubface.

15. The golf club of claim 13, wherein the clubhead includes a toe and a heel, and wherein the line of centers of percussion runs through a point on the clubface located closer to the toe than the heel.

16. The golf club of claim 13, wherein the clubhead includes a toe and a heel, and wherein the line of centers of percussion runs through a point on the clubface located closer to the heel than the toe.

17. The golf club of claim 13, wherein the line of centers of percussion divides the clubface into two sections of substantially equal surface areas.

18. The golf club of claim 12, wherein the visual indication on the clubface is a permanent stain.

19. A golf club comprising:

a) a clubhead including a clubface and a sole, the clubface having a centroid, the sole having a toe-ward sole portion and a heel-ward sole portion; and b) a shaft connected to the clubhead, the shaft having a shaft axis;

wherein a line of centers of percussion which is distinct from the shaft axis divides the clubhead into two portions of different masses and substantially equal moments of inertia about the shaft axis;

wherein said line of centers of percussion runs substantially parallel to the shaft axis and intersects the centroid or an area immediately surrounding the centroid;

wherein the toe-ward sole portion and the heel-ward sole portion intersect at a peak so as to form a sole profile which presents a reduced area of contact when the clubhead hits the ground; and wherein said line of centers of percussion intersects the sole at said peak so tint both ball impacts on the line of centers of percussion and ground contact at the peak cause minimal twisting of the shaft.

20. The golf club of claim 19, wherein said line of centers of percussion is visually marked on the clubface.

* * * * *